US010682856B2

(12) United States Patent
Veis et al.

(10) Patent No.: US 10,682,856 B2
(45) Date of Patent: Jun. 16, 2020

(54) PRINTHEAD NOZZLES ORIENTATION

(71) Applicant: HP SCITEX LTD., Netanya (IL)

(72) Inventors: Alex Veis, Kadima (IL); Ron Tuttnauer, Netanya (IL); Shimi Nakash, Ness Ziona (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 16/010,066

(22) Filed: Jun. 15, 2018

(65) Prior Publication Data

US 2019/0092018 A1 Mar. 28, 2019

(30) Foreign Application Priority Data

Sep. 27, 2017 (EP) ..... 17193443

(51) Int. Cl.

| | |
|---|---|
| ***B41J 2/14*** | (2006.01) |
| ***B41J 2/155*** | (2006.01) |
| ***B41M 7/00*** | (2006.01) |
| ***B41J 11/00*** | (2006.01) |

(52) U.S. Cl.

CPC ..... *B41J 2/155* (2013.01); *B41J 2/14201* (2013.01); *B41J 11/0015* (2013.01); *B41M 7/0018* (2013.01); *B41J 2002/14475* (2013.01); *B41J 2202/11* (2013.01); *B41J 2202/21* (2013.01)

(58) Field of Classification Search

CPC ..... B41J 2/1404; B41J 2/14032

See application file for complete search history.

(56) References Cited

U.S. PATENT DOCUMENTS

| | | | | |
|---|---|---|---|---|
| 5,261,601 | A * | 11/1993 | Ross | A61M 15/0085 128/200.16 |
| 5,609,798 | A * | 3/1997 | Liu | B01F 3/04021 239/338 |
| 6,981,757 | B2 | 1/2006 | Silverbrook et al. | |
| 7,175,263 | B2 | 2/2007 | Colombat et al. | |
| 2002/0018095 | A1* | 2/2002 | Nakamura | B41J 2/14233 347/40 |
| 2005/0255249 | A1* | 11/2005 | Schlatterbeck | B05B 12/04 427/372.2 |
| 2006/0038841 | A1 | 2/2006 | Silverbrook et al. | |
| 2008/0311307 | A1* | 12/2008 | Bulovic | B05B 17/0638 427/466 |
| 2010/0171780 | A1* | 7/2010 | Madigan | B41J 2/14 347/12 |
| 2013/0083106 | A1* | 4/2013 | Tsukamoto | B41J 2/04528 347/10 |
| 2014/0160200 | A1* | 6/2014 | Kim | B41J 2/14233 347/40 |
| 2017/0157844 | A1 | 6/2017 | Mandel et al. | |

(Continued)

FOREIGN PATENT DOCUMENTS

| | | |
|---|---|---|
| CN | 1483578 | 3/2004 |
| CN | 1668386 | 9/2005 |

(Continued)

*Primary Examiner* — Scott A Richmond

(74) *Attorney, Agent, or Firm* — HP Inc. Patent Department

(57) ABSTRACT

In one example of the disclosure, a system includes a chamber having an inlet to receive a print agent, an actuator operatively connected to the chamber, and a set of nozzles fluidly coupled to the chamber. The nozzles are orientated such that each nozzle of the set has a same boundary condition.

21 Claims, 7 Drawing Sheets

(56) References Cited

U.S. PATENT DOCUMENTS

| | | | | |
|---|---|---|---|---|
| 2018/0001657 | A1* | 1/2018 | Yamanobe | B41J 2/04558 |
| 2018/0257377 | A1* | 9/2018 | Suzuki | B41J 2/14209 |

FOREIGN PATENT DOCUMENTS

| | | | | |
|---|---|---|---|---|
| CN | 101314277 | | 12/2008 | |
| EP | 0863020 | | 9/1998 | |
| EP | 2009006700 | | 1/2009 | |
| JP | 2001056407 | | 2/2001 | |
| JP | 2006068941 | | 3/2006 | |
| JP | 2012250492 | | 12/2012 | |
| JP | 2013193399 | | 9/2013 | |
| JP | 2018149683 | A * | 9/2018 | B41J 2/155 |
| WO | WO-0114915 | | 3/2001 | |

* cited by examiner

PRINTHEAD NOZZLES ORIENTATION

BACKGROUND

Packaging boxes made of corrugated or folding carton materials are frequently printed upon using an overcoat layer (e.g., a transparent varnish or semi-transparent varnish) on top of the ink. This overcoat layer is to protect the ink and paper from scratching, ink smearing and moisture. The overcoat layer also adds gloss and color gamut to printed images. There are many types of overcoats with varied gloss and mate appearance, protection levels, and friction coefficients.

DRAWINGS

DETAILED DESCRIPTION OF EXAMPLES

Figure 1:
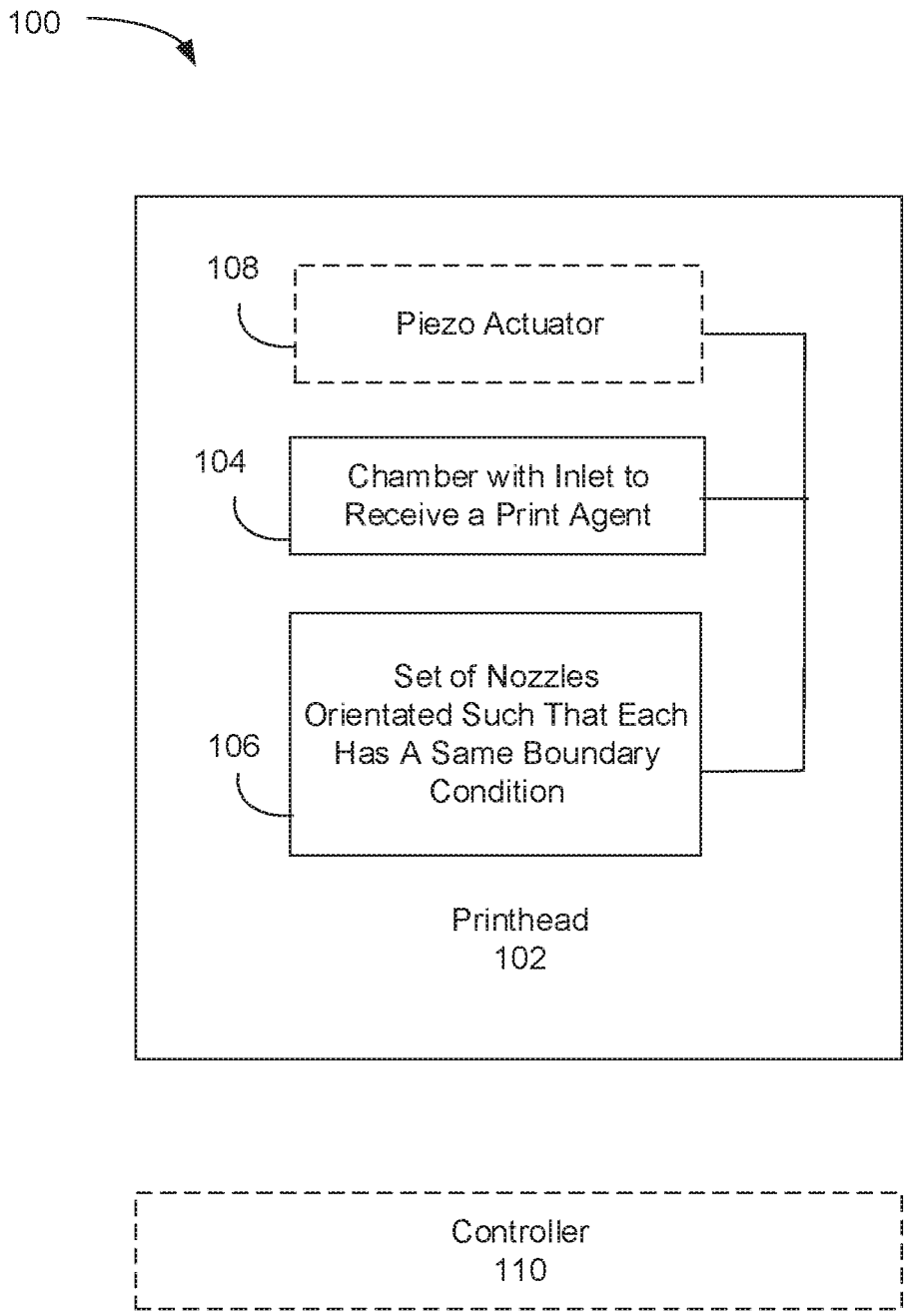
FIG. 1 is a block diagram illustrating an example of a system for applying a print agent in a uniform manner to a substrate.

Using printheads to jet overcoats, primers, and other fluids that have high solid content onto packaging boxes has historically been a complex and expensive endeavor. One approach for applying high viscosity printing fluids such as primers and overcoats has been to utilize traditional high resolution/high nozzle density printheads that distribute fluids at a high resolution (e.g., 600 dpi to 1200 dpi), utilizing small drops (5 pl to 20 pl). The high nozzle densities enable sharper text and higher quality printings for printing of inks. To utilize such a high resolution printhead for applying high viscosity fluids such as primers and overcoats, however the fluid may need be deposited evenly in multiple thin layers (0.5 um to 3 um). Applying such print agents in multiple layers can be expensive in terms of the number of printheads required and the time to accomplish the desired fluid coverage.

Another approach for applying high viscosity printing fluids is utilize fewer nozzles to accomplish low resolution jetting. With this approach very large drops are used to fully cover the media. However, with traditional low resolution fluid jetting methods the applied primer or overcoat may not easily be spread to accomplish the desired coverage and thickness. Typically a low resolution jetting printhead is a piezo printhead constructed such that every fluid chamber has a single nozzle that is to eject a drop when voltage is applied to a piezoelectric plate at the printhead. Manufacturing such piezo printheads may utilize complex photoetching processes, such that the cost per nozzle becomes an issue.

An alternative to the conventional one chamber to one nozzle piezo printhead configuration for low resolution fluid ejection is a one chamber with multiple nozzles configuration that may dramatically reduce the cost per printhead and cost per nozzle. However, one chamber to multiple nozzle piezo printhead configurations commonly have issues with drop velocity variation and drop directionality due to asymmetries in boundary conditions of nozzles. To address these issues, various examples described in more detail below provide a system and method for applying a print agent in a uniform manner to a substrate. In an example, a printhead system includes a chamber with an inlet to receive a print agent, a piezoelectric element attached to the chamber, and a set of nozzles fluidly coupled to the chamber. The nozzles are oriented such that each of the set of nozzles has a same boundary condition. In an example, the boundary condition is that, when a substrate is moved beneath the nozzles in a scan direction during a print operation, the nozzles are spaced in a cross scan direction at a same distance "d." In another example, the boundary condition is that each of the plurality of nozzles is a same distance "r" from center of the actuator. In an example, the chamber of the printhead has a polygon shape at a firing side of the chamber. In an example, the chamber of the printhead has a circular or an elliptical shape at a firing side of the chamber. In examples, the print agent to be received at the inlet of the chamber and to be distributed via the nozzles is a primer or an overcoat varnish. In examples the print agent is a transparent overcoat varnish that is to protect a printed-upon corrugated or folding carton substrate from scratching, smearing, and/or moisture damage.

Users of the disclosed system and method can significantly reduce the cost of priming and overcoat applications when printing to corrugated, folding carton, and other substrates. In this manner users will appreciate both the cost effectiveness and the high print agent application quality enabled by the disclosed system and method. Manufacturers and providers of printing devices will enjoy the competitive the benefits of offering the system and method for applying a print agent in a uniform manner disclosed herein.

FIG. 1 is a block diagram illustrating an example of a system for applying a print agent in a uniform manner to a substrate. System 100 illustrates a piezo printhead 102 including a chamber 104 with an inlet to receive a print agent. As used herein, a "printhead" refers generally to a mechanism for ejection of a print agent. As used herein, "print agent" refers generally to any substance that can be applied upon a media by a printer during a printing operation, including but not limited to primers and overcoat materials (such as a varnish). As used herein, a "primer" refers generally to any substance that is applied to a substrate as a preparatory coating in advance of application of ink to the substrate length. As used herein an "ink" refers generally to a fluid that is to be applied to a media during a printing operation to form an image upon the media. In examples, the applied primer may be a water soluble polymer. As used herein an "overcoat" refers generally to any substance that is applied to a substrate as a protective or embellishment coating after a printing device has applied an ink film to the substrate to form an image. In examples the overcoat may be a transparent ultraviolet ("UV") coating that is applied to the web substrate and then cured utilizing an ultraviolet light. In other examples, the overcoat may be an aqueous clear varnish applied without a UV curing process.

Piezo actuator 108 is operatively connected to chamber 104. In examples, system 100 may include a controller 110 to cause actuation of the piezoelectric actuator 108 to cause print agent to flow from chamber 104 through set of nozzles 106. Piezo activator 108 is to, when a voltage waveform is applied, generate a pressure pulse that causes chamber 104 to change shape, forcing droplets of the fluid from a set of nozzles 106. Piezoelectric printheads have an advantage of working with a wide variety of fluids, as since the ejection is via pressure rather than an explosion there is no requirement that the fluid include a volatile component. Further, the piezoelectric printhead can eject the fluid at a variety of ejection velocities, according to what will most advantageous for a particular print job or printer. Each nozzle of the set of nozzles 106 is fluidly coupled to chamber 104.

The set of nozzles 106 is symmetrically arranged such that each subject nozzle of the set has the same boundary conditions as neighbor nozzles to the subject nozzle. As used herein, a first nozzle having a same "boundary condition" as a second nozzle refers generally to the first and second nozzles being arranged in manner wherein the first and second nozzles have a common spatial or distance attribute with respect to a reference point or reference points. In an example, a boundary condition may be that, when a substrate is moved beneath the nozzles in a scan direction during a print operation, the nozzles are spaced in a cross scan direction at a same distance "d." In another example, a boundary condition may be that the first and second nozzles are a same distance "r" from center of the actuator. In another example, a boundary condition may be that the first and second nozzles are a same distance "s" from a wall, or a corner formed by walls, of the chamber. Other boundary conditions may be established and implemented to create a symmetrical arrangement of nozzles on a printhead, and such other boundary conditions are contemplated by this disclosure.

Figure 2:
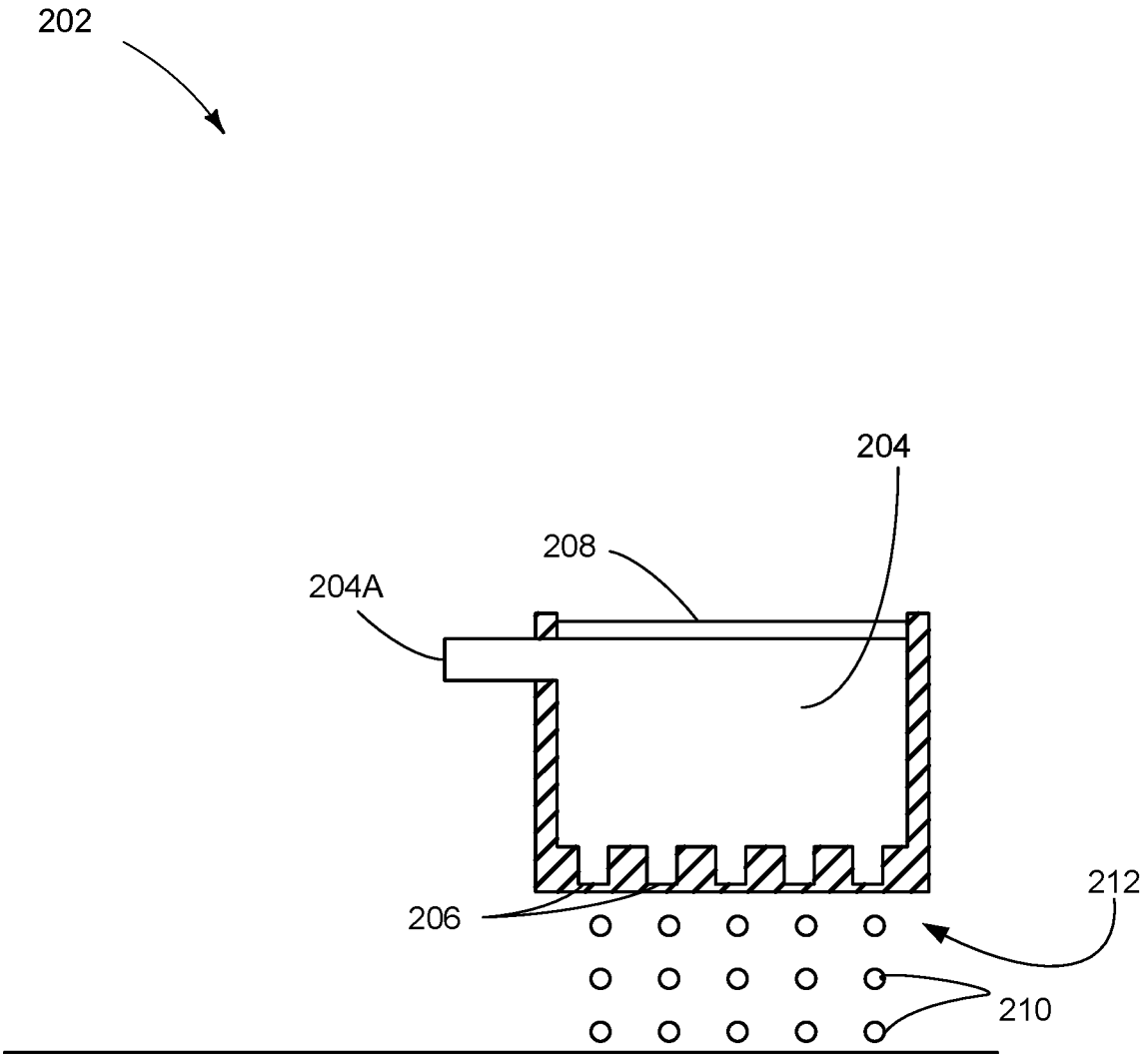
FIG. 2 is a side perspective view of a printhead assembly for applying a print agent in a uniform manner to a substrate, wherein a set of nozzles is orientated such that each nozzle has a same boundary condition.

FIG. 2 is a side perspective view of a printhead assembly 202 for applying a print agent in a uniform manner to a substrate. In this example, printhead assembly 202 includes a chamber 204 having an inlet 204A to receive a print agent from a print agent supply source (e.g., a tank, reservoir, or other print agent supply source). In examples the print agent may be a primer, an overcoat varnish, or another type of print agent. Printhead assembly 202 includes a piezo plate 208 operatively connected to chamber 204. A plurality of nozzles 206 are fluidly coupled to the chamber. The nozzles 206 are orientated such that each of the plurality of nozzles has a same boundary condition.

In an example, printhead assembly may receive an electronic actuation signal or instruction (e.g., a voltage waveform) to cause actuation of piezo plate 208 to cause print agent to flow from chamber 204 through set of nozzles 206. Piezo plate 208 is to, when the signal or instruction is received, generate a pressure pulse that causes chamber 204 to change shape, forcing droplets 210 of the print agent to eject from the set of nozzles 206 at a firing side 212 of the chamber, As used herein a "firing side" of a printhead chamber refers generally to a side of the chamber that is adjacent to the nozzles from which print agent is to be ejected upon a substrate.

Figure 3:
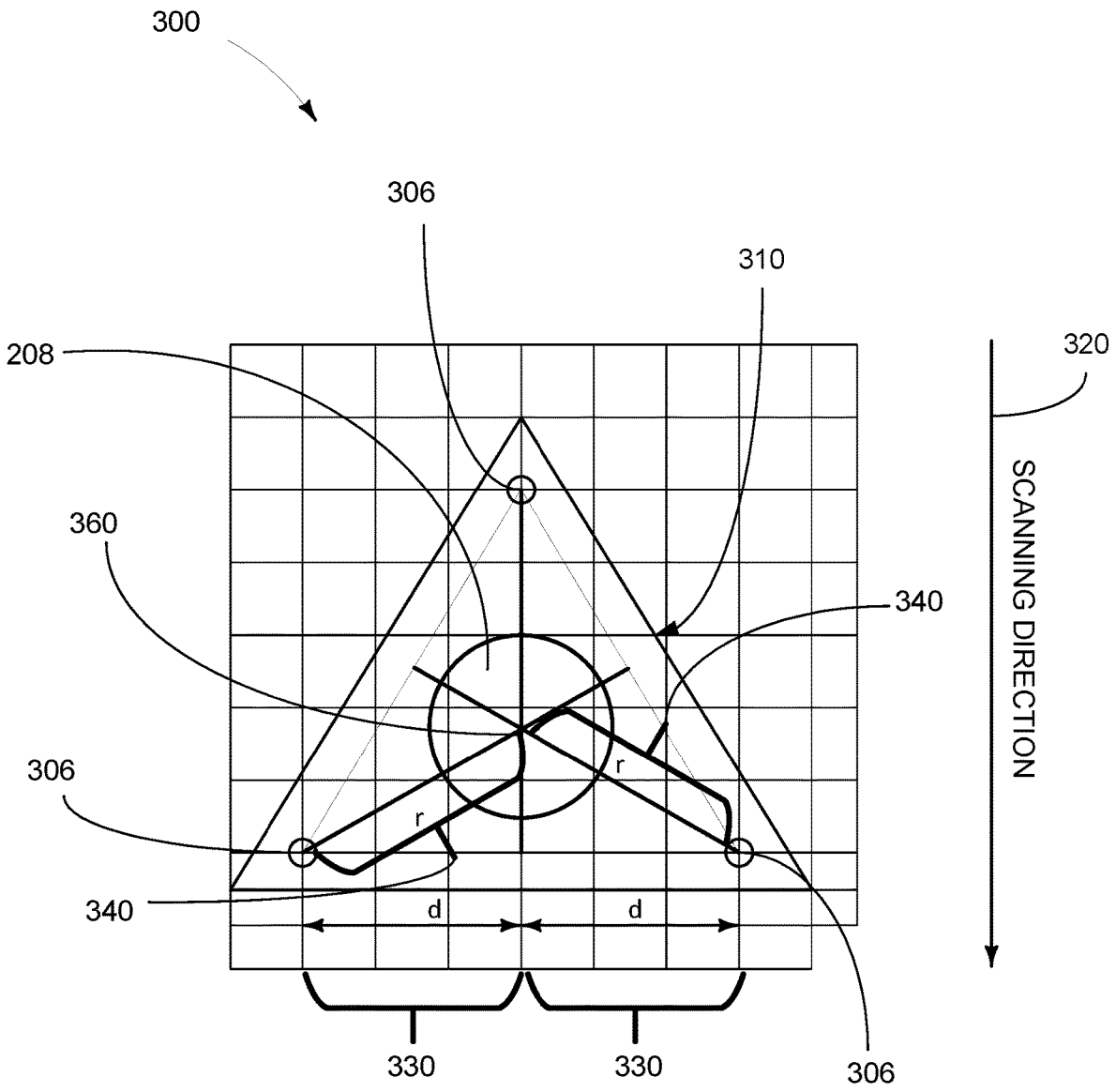
FIG. 3 is a perspective view of a printhead assembly for applying a print agent in a uniform manner to a substrate, wherein a chamber of the printhead assembly has a triangular shape at a firing side and a set of three nozzles is orientated such that each nozzle has a same boundary condition.

FIG. 3 is a perspective view of a printhead assembly 300 for applying a print agent in a uniform manner to a substrate. In this example, the chamber 204 (FIG. 2) of printhead assembly 202 (FIG. 2) has a triangular shape 310 at the firing side 212 (FIG. 2) of the chamber. Printhead assembly 300 includes a set of three nozzles 306 and is orientated such that each of the three nozzles has a same boundary condition. In this example, the three nozzles 306 are arranged such that, when a substrate is moved beneath the nozzles in a scan direction 320 during a print operation, the nozzles 306 are spaced in a cross scan direction at a same distance "d" 330. In the example of FIG. 3, the set of three nozzles 306 also share a boundary condition that each of the nozzles of the set is a same distance "r" 340 from a center 360 of the piezo actuator 208.

Figure 4:
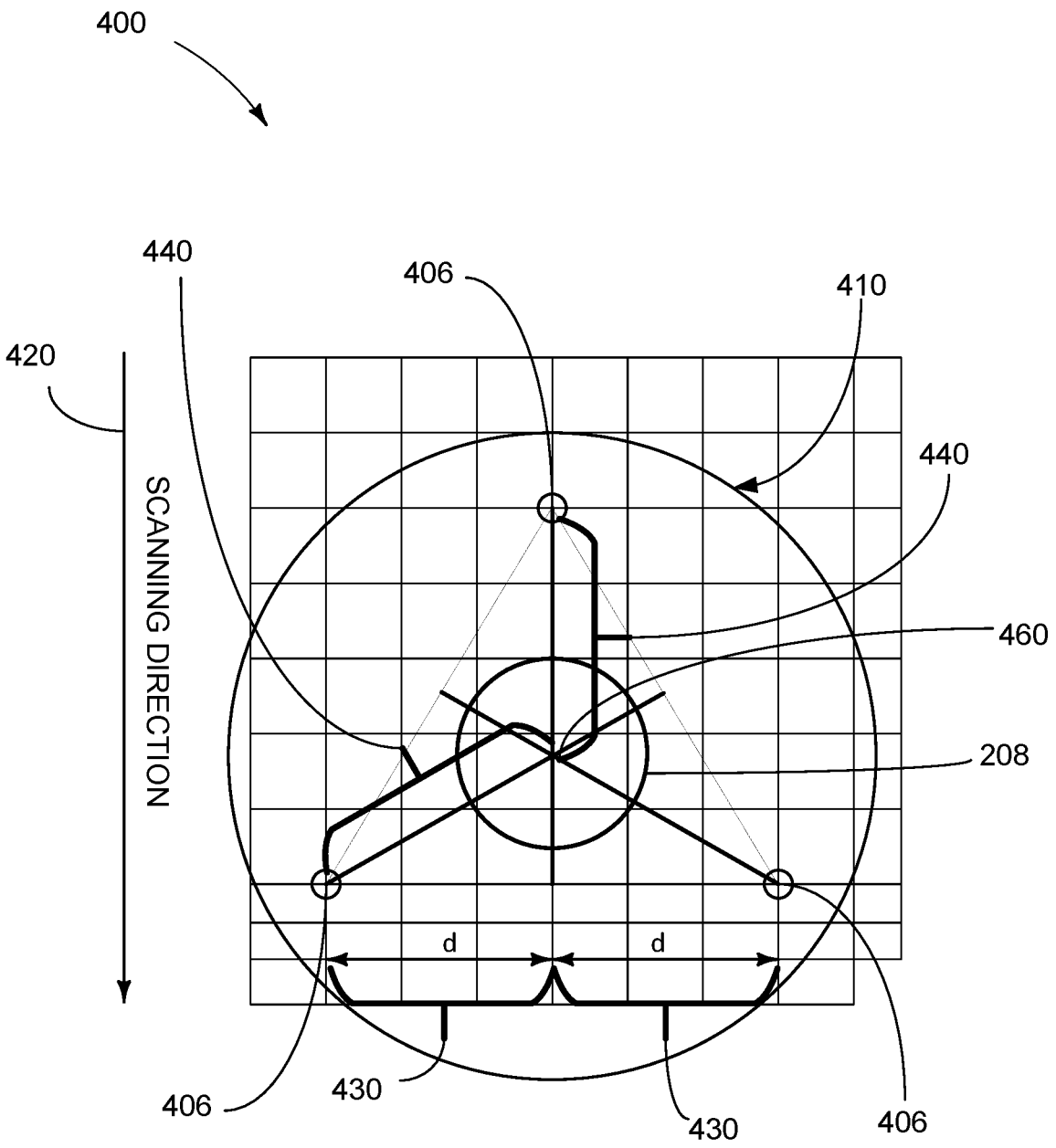
FIG. 4 is a perspective view of a printhead assembly for applying a print agent in a uniform manner to a substrate, wherein a chamber of the printhead assembly has a circular shape at a firing side and a set of three nozzles is orientated such that each nozzle has a same boundary condition.

FIG. 4 is a perspective view of a printhead assembly 400 for applying a print agent in a uniform manner to a substrate. In this example, the chamber 204 (FIG. 2) of printhead assembly 202 (FIG. 2) has a circular shape 410 at the firing side 212 (FIG. 2) of the chamber. Printhead assembly 400 includes a set of three nozzles 406 and is orientated such that each of the three nozzles has a same boundary condition. In this example, the three nozzles 406 are arranged such that, when a substrate is moved beneath the nozzles in a scan direction 420 during a print operation, the nozzles 406 are spaced in a cross scan direction at a same distance "d" 430. In this example, the set of three nozzles 406 also share a boundary condition that each of the nozzles of the set is a same distance "r" 440 from a center 460 of the piezo actuator 208.

Figure 5:
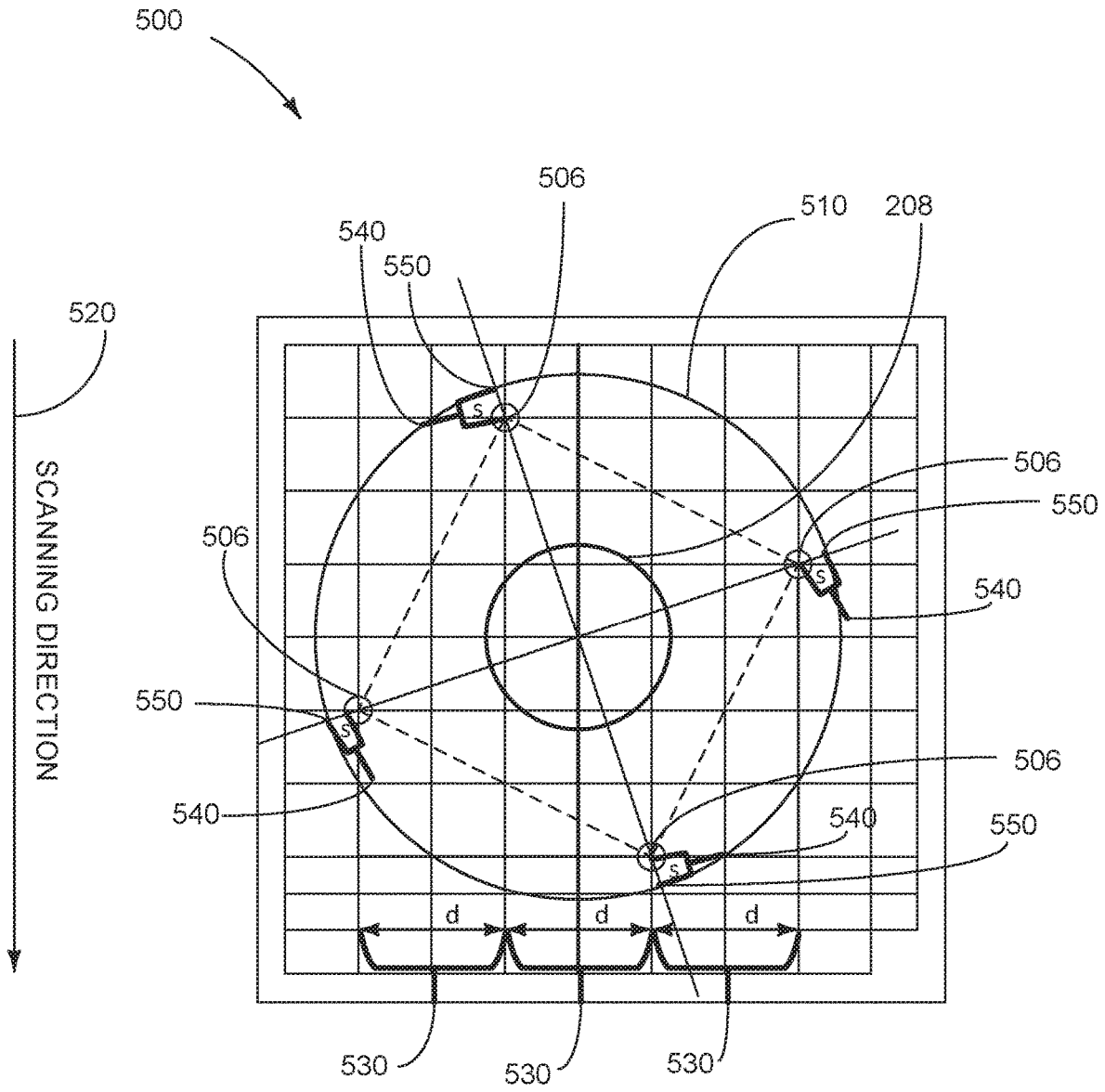
FIG. 5 is a perspective view of a printhead assembly for applying a print agent in a uniform manner to a substrate, wherein a chamber of the printhead assembly has a circular shape at a firing side and a set of four nozzles is orientated such that each nozzle has a same boundary condition.

FIG. 5 is a perspective view of a printhead assembly 500 for applying a print agent in a uniform manner to a substrate. In this example, the chamber 204 (FIG. 2) of printhead assembly 202 (FIG. 2) has a circular shape 510 at the firing side 212 (FIG. 2) of the chamber. Printhead assembly 500 includes a set of four nozzles 506 and is orientated such that each of the four nozzles has a same boundary condition. In this example, the four nozzles 506 are arranged around a piezo actuator 208 such that, when a substrate is moved beneath the nozzles in a scan direction 520 during a print operation, the nozzles 506 are spaced in a cross scan direction at a same distance "d" 530. In this example, the set of four nozzles 506 also share a boundary condition that each of the nozzles of the set is a same distance "s" 540 from a wall 550 of the chamber.

Figure 6:
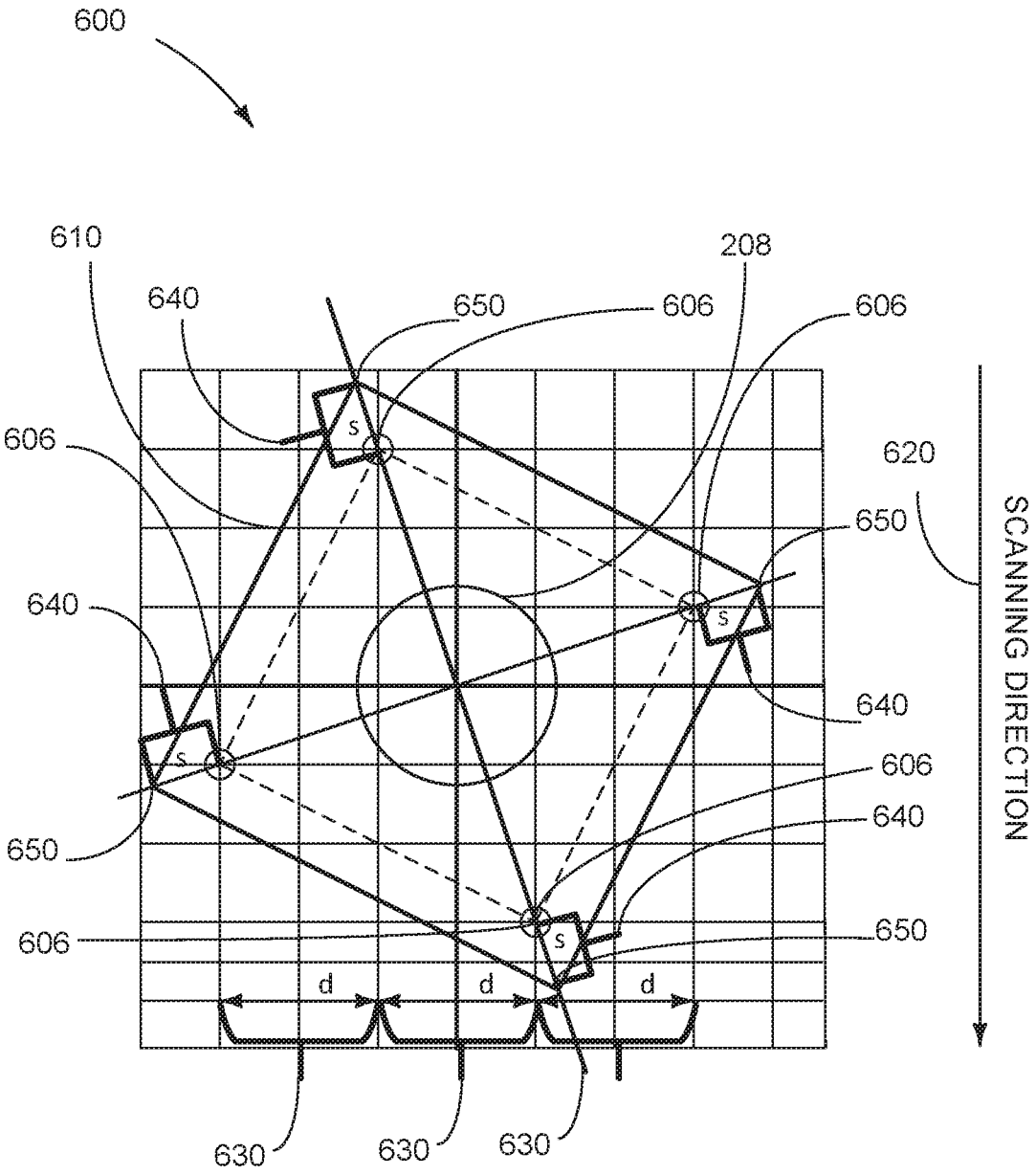
FIG. 6 is a perspective view of a printhead assembly for applying a print agent in a uniform manner to a substrate, wherein a chamber of the printhead assembly has a rectangular shape at a firing side and a set of four nozzles is orientated such that each nozzle has a same boundary condition.

FIG. 6 is a perspective view of a printhead assembly 600 for applying a print agent in a uniform manner to a substrate. Printhead assembly 600 includes a piezoelectric element 208 attached to a chamber 204 (FIG. 2). In this example, the chamber has a rectangular shape 610 at the firing side 212 (FIG. 2) of the chamber. Printhead assembly 600 includes a set of four nozzles 606 and is orientated such that each of the four nozzles has a same boundary condition. In this example, the four nozzles 606 are arranged such that, when a substrate is moved beneath the nozzles in a scan direction 620 during a print operation, the nozzles 606 are spaced in a cross scan direction at a same distance "d" 630. In this example, the set of four nozzles 606 also share a boundary condition that each of the nozzles of the set is a same distance "s" 640 from a corner formed by walls 650 of the rectangular-shaped chamber. In examples, printhead assembly 600 may include a set of more than four nozzles each oriented with a same boundary condition. In examples, chamber 204 (FIG. 2) may be in the shape of a polygon other than a rectangle, or may be in a circular or elliptical shape at the firing side of the chamber. In other examples printhead assembly 600 may include a set of more than four nozzles each oriented with a same boundary condition.

Figure 7:
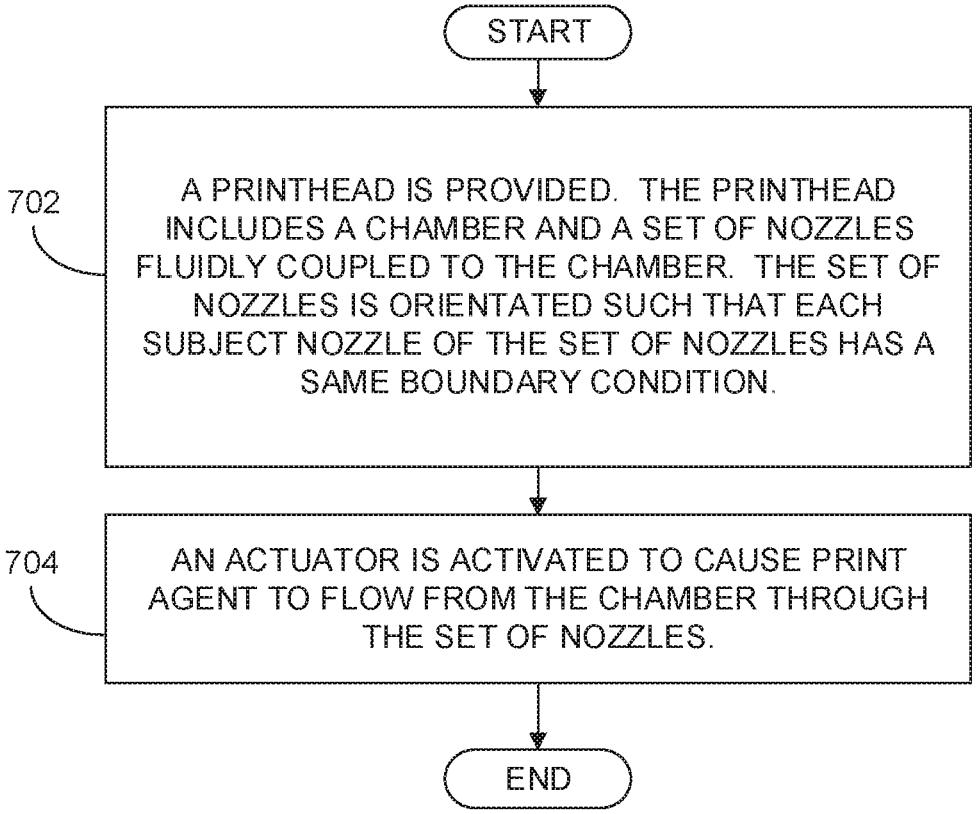
FIG. 7 is a flow chart illustrating a method of applying a fluid print agent in a uniform pattern to a substrate.

FIG. 7 is a flow chart illustrating a method of applying a fluid print agent in a uniform pattern to a substrate. In discussing FIG. 7, reference may be made to the components depicted in FIGS. 1 and 2. Such reference is made to provide contextual examples and not to limit the manner in which the method depicted by FIG. 7 may be implemented. A printhead (e.g., 102, FIG. 1, 300 FIG. 3, 400 FIG. 4, or 500 FIG. 5) is provided including a chamber (e.g., 104 FIG. 1 or 204 FIG. 2) and a set of nozzles (e.g., 106, FIG. 1, 206 FIG. 2, 306 FIG. 3, 406 FIG. 4, or 506 FIG. 5) fluidly coupled to the chamber. The set of nozzles is orientated such that each subject nozzle of the plurality of nozzles has a same boundary condition (e.g., 330 or 340 FIG. 3, 430 or 440 FIG. 4, 530 or 540 FIG. 5, or 630 or 640 FIG. 6 (block 702).

An actuator (e.g. 208 at FIG. 2, FIG. 3, FIG. 4, FIG. 5, or FIG. 6) is activated (e.g., by or via controller 110, FIG. 1) to cause print agent to flow from the chamber through the set of nozzles (block 704).

FIGS. 1-7 aid in depicting the architecture, functionality, and operation of various examples. In particular, FIGS. 1-6 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function (s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 7 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A printhead assembly, comprising:

a chamber having an inlet to receive a print agent;

an actuator operatively connected to the chamber; and a plurality of nozzles each being fluidly coupled to the chamber and extending to an exterior of the printhead assembly to dispense print agent from the chamber to a substrate beneath the printhead assembly, wherein the nozzles are arranged such that, when the substrate is moved beneath the nozzles in a scan direction during a print operation, the nozzles are spaced in a cross scan direction at a same distance d, and each of the plurality of nozzles is also arranged to have a same boundary condition being at a same distance from a side, center or corner of the chamber.

2. The printhead assembly of claim 1, wherein the boundary condition is that each of the plurality of nozzles is a same distance r from a center of the actuator.

3. The printhead assembly of claim 1, wherein the chamber has a polygon shape at a firing side of the chamber.

4. The printhead assembly of claim 3, wherein the chamber has a triangle shape at a firing side of the chamber and the boundary condition is that each nozzle is a same distance r from a center of the actuator.

5. The printhead assembly of claim 3, wherein the chamber has a square shape at a firing side of the chamber and the boundary condition is that each nozzle is a same distance s from a corner of the square chamber.

6. The printhead assembly of claim 1, wherein the chamber has a circular or an elliptical shape at a firing side of the chamber.

7. The printhead assembly of claim 6, wherein the chamber has a circular shape at a firing side of the chamber and the boundary condition is that each nozzle is a same distance r from a center of the actuator.

8. The printhead assembly of claim 6, wherein the chamber has a circular shape at a firing side of the chamber and the boundary condition is that each nozzle is a same distance s from a side of the chamber.

9. The printhead assembly of claim 1, wherein the print agent is a transparent print agent.

10. The printhead assembly of claim 1, wherein the print agent is a primer or an overcoat.

11. The printhead assembly of claim 1, wherein the actuator is a piezo actuator.

12. A system for applying a print agent in a uniform manner to a substrate, comprising:

a chamber having an inlet to receive a print agent;

a piezoelectric element attached to the chamber;

a plurality of nozzles each being fluidly coupled to the chamber and extending to an exterior of a printhead of the system where the print agent from the chamber is dispensed to a substrate beneath the printhead assembly, wherein the nozzles are arranged non-linearly around a geometric shape and such that, when the substrate is moved beneath the nozzles in a scan direction during a print operation, the nozzles are spaced in a cross scan direction at a same distance d; and a controller, to cause actuation of the piezoelectric element to cause print agent to flow from the chamber through the plurality of nozzles.

13. The system of claim 12, wherein each of the plurality of nozzles is a same distance r from center of the piezoelectric element.

14. The system of claim 12, wherein each of the plurality of nozzles is a same distance s from a wall of the chamber.

15. The system of claim 12, wherein the print agent is a transparent print agent.

16. The system of claim 12, wherein the chamber has a polygon shape at a firing side of the chamber and the nozzles are arranged around the polygon shape of the chamber.

17. The system of claim 12, wherein the chamber has a circular or an elliptical shape at a firing side of the chamber and the nozzles are arranged around the circular or elliptical shape of the chamber.

18. A method of applying a fluid print agent in a uniform pattern to a substrate, comprising:

providing a printhead that includes a chamber and a plurality of nozzles fluidly coupled to the chamber, wherein each nozzle comprises a fluid path that extends from the chamber to an exterior of the printhead where the print agent is released to the substrate, and the nozzles are arranged such that each nozzle of the plurality of nozzles is located having a same boundary condition;

flowing fluid print agent into the chamber; and causing activation of an actuator in the chamber to cause print agent to flow from the chamber through the plurality of nozzles, droplets of the fluid print agent being dispensed from the plurality of nozzles out of the printhead to the substrate being printed.

19. The method of claim 18, wherein the boundary condition is that, when a substrate is moved beneath the nozzles in a scan direction during a print operation, the nozzles are spaced in a cross scan direction at a same distance d.

20. The method of claim 18, wherein the print agent is a primer or an overcoat varnish.

21. The method of claim 18, wherein the nozzles are arranged such that each nozzle of the plurality of nozzles is located having a same boundary condition being at a same distance from a side, center or corner of the chamber.

* * * * *